US010057703B2

(12) United States Patent
Wu

(10) Patent No.: US 10,057,703 B2
(45) Date of Patent: Aug. 21, 2018

(54) APPARATUS AND METHOD FOR SOUND STAGE ENHANCEMENT

(71) Applicant: Ambidio, Inc., Los Angeles, CA (US)

(72) Inventor: Tsai-Yi Wu, Alhambra, CA (US)

(73) Assignee: AMBIDIO, INC., Alhambra, CA (US)

( * ) Notice: Subject to any disclaimer, the term of this patent is extended or adjusted under 35 U.S.C. 154(b) by 0 days.

(21) Appl. No.: 15/349,822

(22) Filed: Nov. 11, 2016

(65) Prior Publication Data

US 2017/0064481 A1 Mar. 2, 2017

Related U.S. Application Data

(63) Continuation of application No. 14/569,490, filed on Dec. 12, 2014, now Pat. No. 9,532,156.

(60) Provisional application No. 61/916,009, filed on Dec. 13, 2013, provisional application No. 61/982,778, filed on Apr. 22, 2014.

(51) Int. Cl.

| | |
|---|---|
| ***H04R 5/00*** | (2006.01) |
| ***H04S 1/00*** | (2006.01) |
| ***H04R 3/12*** | (2006.01) |
| *G10L 19/008* | (2013.01) |

(52) U.S. Cl.

CPC ..... *H04S 1/007* (2013.01); *H04R 3/12* (2013.01); *G10L 19/008* (2013.01); *H04S 2400/01* (2013.01); *H04S 2400/09* (2013.01); *H04S 2420/01* (2013.01); *H04S 2420/07* (2013.01)

(58) Field of Classification Search

CPC .. H04S 1/007; H04S 2400/01; H04S 2420/01; H04S 2420/07; H04R 3/12; G10L 19/008

See application file for complete search history.

(56) References Cited

U.S. PATENT DOCUMENTS

2008/0031462 A1* 2/2008 Walsh ..... H04S 3/02 381/17
2011/0119061 A1* 5/2011 Brown ..... G10L 19/008 704/258
2011/0026281 A1 11/2011 Dinei et al.

(Continued)

FOREIGN PATENT DOCUMENTS

JP 11-187497 A 7/1999

OTHER PUBLICATIONS

Ambidio, Inc., Extended European Search Report, EP14869941.6, dated Jul. 6, 2017, 8 pgs.

(Continued)

*Primary Examiner* — Andrew L Sniezek

(74) *Attorney, Agent, or Firm* — Morgan, Lewis & Bockius LLP

(57) ABSTRACT

A non-transitory computer readable storage medium with instructions executable by a processor identify a center component, a side component and an ambient component within right and left channels of a digital audio input signal. A spatial ratio is determined from the center component and side component. The digital audio input signal is adjusted based upon the spatial ratio to form a pre-processed signal. Recursive crosstalk cancellation processing is performed on the pre-processed signal to form a crosstalk cancelled. The center component of the crosstalk cancelled signal is realigned to create the final digital audio output.

18 Claims, 5 Drawing Sheets

(56) References Cited

U.S. PATENT DOCUMENTS

2012/0076307 A1* 3/2012 Den Brinker ..... H04S 3/002 381/17
2014/0235192 A1* 8/2014 Purnhagen ..... G10L 19/008 455/296

OTHER PUBLICATIONS

Ambidio, Inc., Communication Pursuant to Rules 70-2-and-70a-2 and 162, EP14869941.6, dated Jul. 25, 2017, 1 pg.
Ambidio, Inc., International Preliminary Report on Patentability, PCT/US2014/070143, dated Jun. 14, 2016, 4 pgs.
Ambidio, Inc., Notification of First Office Action, CN201480075389.4, dated May 15, 2017, 22 pgs.
Ambidio, Inc., Notice to File a Response, KR10-2016-7018300, dated Oct. 31, 2016, 6 pgs.
Ambidio, Inc., Notice to File a Response, KR10-2016-7018300, dated Mar. 29, 2017, 5 pgs.
Wu, Tsai-yi, Communication Pursuant to Rules 161(2) and 162, EP14869941.6, dated Jul. 20, 2017, 2 pgs.
Wu, International Search Report and Written Opinion, PCT/US2014/070143, dated Mar. 11, 2016, 6 pgs.
Wu et al., "Ambidio:Sound Stage Width Extension for Internal Laptop Loudspeakers," Audio Engineering Society Convention Paper, 136th Convention, Apr. 26-29, 2014, Berlin Germany, 8 pgs.
Wu et al., "Listening with Realism: Sound Stage Extension for Laptop Speakers," Thesis, Dec. 6, 2013, Steinhardt School, New York University, 81 pgs.
Wu, Office Action, U.S. Appl. No. 14/569,490, dated Mar. 23, 2016, 7 pgs.
Wu, Notice of Allowance, U.S. Appl. No. 14/569,490, dated Aug. 26, 2016, 7 pgs.
Wu, Notice of Reasons for Rejection, JP2016536977, dated Feb. 3, 2017, 12 pgs.
Ambidio, Inc., Notice of Allowance, KR10-2016-7018300, dated Aug. 29, 2017, 3 pgs.
Ambidio, Inc., Certificate of Patent, KR10-2016-7018300, Nov. 29, 2017, 2 pgs.

* cited by examiner

APPARATUS AND METHOD FOR SOUND STAGE ENHANCEMENT

CROSS-REFERENCE TO RELATED APPLICATION

This application is a continuation application of U.S. patent application Ser. No. 14/569,490, filed Dec. 12, 2014 and entitled "Apparatus and Method for Sound Stage Enhancement", which claims the benefit of Provisional Application Ser. No. 61/916,009 filed Dec. 13, 2013 and U.S. Provisional Patent Application Ser. No. 61/982,778 filed Apr. 22, 2014, the contents of which are incorporated herein by reference.

FIELD OF THE INVENTION

This invention relates generally to processing of digital audio signals. More particularly, this invention relates to techniques for sound stage enhancement.

BACKGROUND OF THE INVENTION

A sound stage is the distance perceived between the left and right limits of a stereophonic scene. A stereo image includes phantom images that appear to occupy the sound stage. A good stereo image is needed in order to convey a natural listening environment. A flat and narrow stereo image makes all sound perceived as coming from one direction and therefore the sound appears monophonic.

Consumer electronic devices (e.g., desk top computers, laptop computer, tablets, wearable computers, game consoles, televisions and the like) commonly include speakers. Unfortunately, space limitations result in poor sound stage performance. Attempts have been made to address this problem using Head-Related Transfer Functions (HRTFs). HRTFs are used to create virtual surround sound speakers. Unfortunately, HRTFs are based upon one individual's ears and body shape. Therefore, any other ear can experience spatial distortion with degraded sound localization.

Accordingly, it would be desirable to obtain enhanced sound stage performance in consumer devices without relying upon synthesized or measured HRTFs.

SUMMARY OF THE INVENTION

A non-transitory computer readable storage medium with instructions executable by a processor identify a center component, a side component and an ambient component within right and left channels of a digital audio input signal. A spatial ratio is determined from the center component and side component. The digital audio input signal is adjusted based upon the spatial ratio to form a pre-processed signal. Recursive crosstalk cancellation processing is performed on the pre-processed signal to form a crosstalk cancelled signal. The center component of the crosstalk cancelled signal is realigned in a post-processing operation to create the digital audio output.

BRIEF DESCRIPTION OF THE FIGURES

The invention is more fully appreciated in connection with the following detailed description taken in conjunction with the accompanying drawings, in which.

Like reference numerals refer to corresponding parts throughout the several views of the drawings.

DETAILED DESCRIPTION OF THE INVENTION

Figure 1:
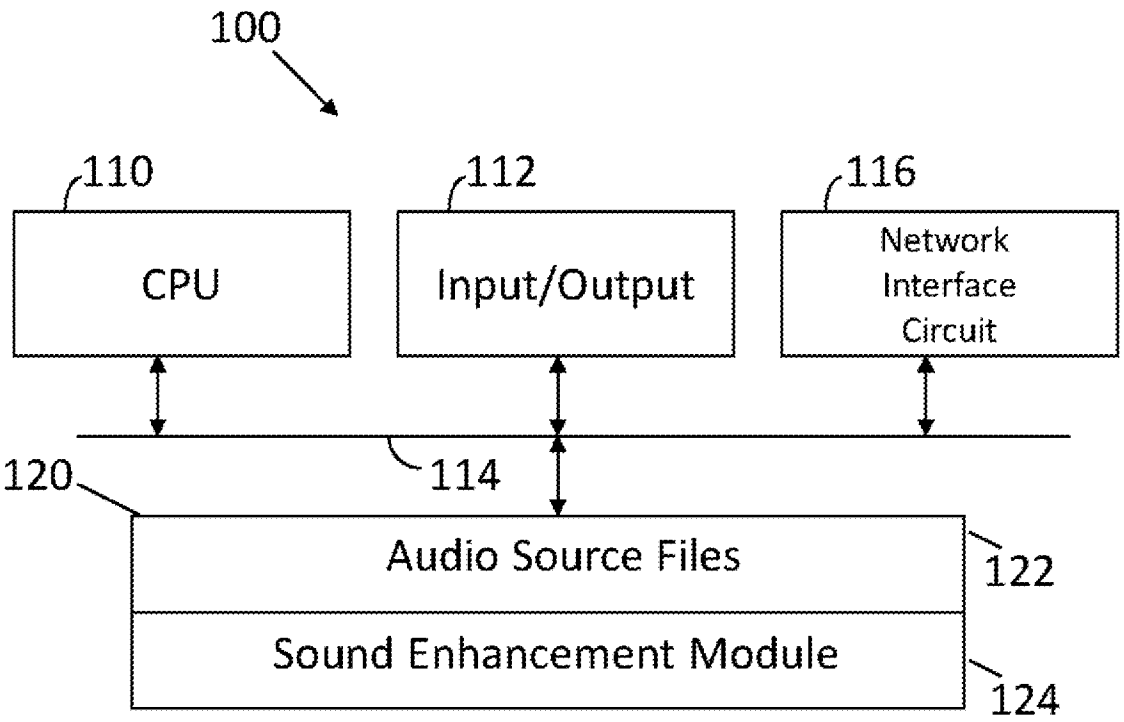
FIG. 1 illustrates a consumer electronic device configured in accordance with an embodiment of the invention.

FIG. 1 illustrates a digital consumer electronic device 100 configured in accordance with an embodiment of the invention. The device 100 includes standard components, such as a central processing unit 110 and input/output devices 112 connected via a bus 114. The input/output devices 112 may include a keyboard, mouse, touch display, speakers and the like. A network interface circuit 116 is also connected to the bus 114 to provide connectivity to a network (not shown). The network may be any combination of wired and wireless networks.

A memory 120 is also connected to the bus 114. The memory 120 includes one or more audio source files 122 containing audio source signals. The memory 120 also stores a sound enhancement module 124, which includes instructions executed by central processing unit 110 to implement operations of the invention, as discussed below. The sound enhancement module 124 may also process a streaming audio signal received through network interface circuit 116.

Figure 2:
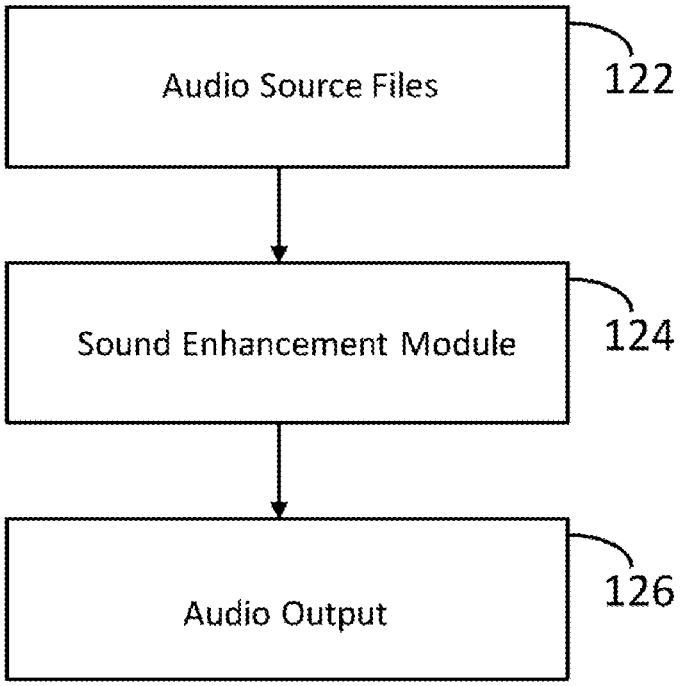
FIG. 2 illustrates signal processing in accordance with embodiments of the invention.

FIG. 2 illustrates that the sound enhancement module 124 may receive audio source files 122 (e.g., stereo source files). The sound enhancement module 124 processes the audio source files to generate enhanced audio output 126 (e.g., enhanced stereophonic sound with a strong center stage and side components).

Figure 3:
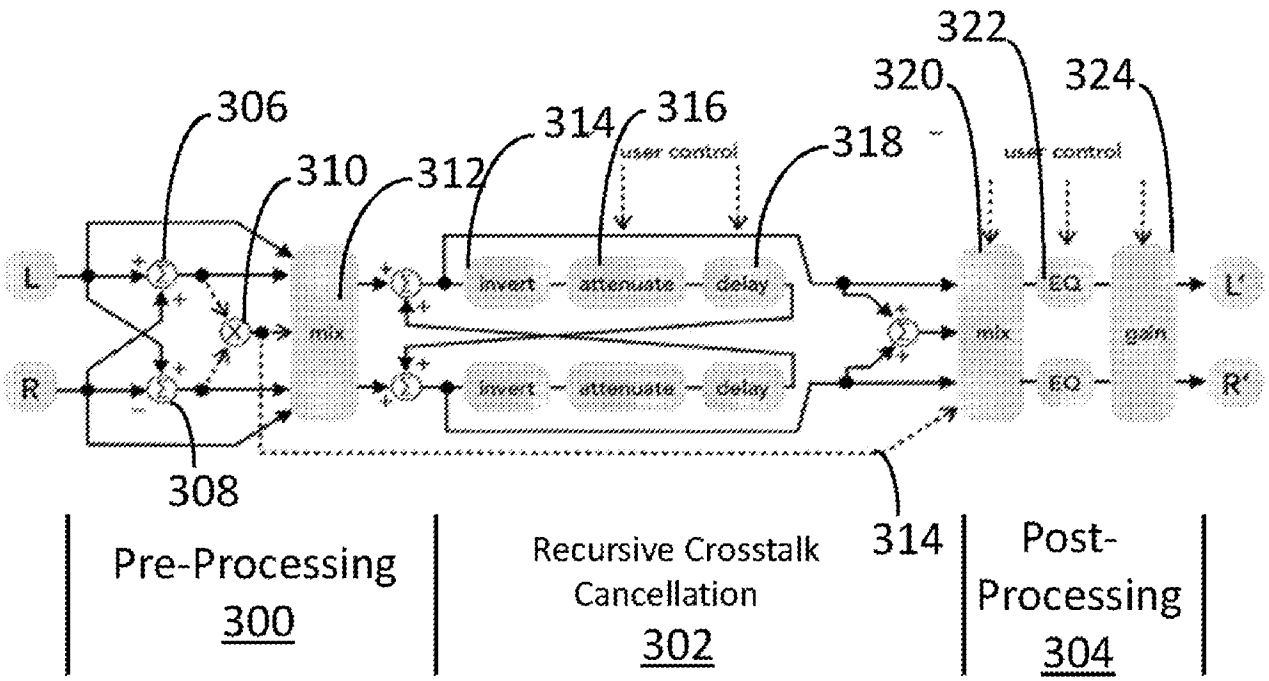
FIG. 3 illustrates a sound enhancement module configured in accordance with an embodiment of the invention.

FIG. 3 illustrates an embodiment of the sound enhancement module 124. In this case, the input is Left (L) and Right (R) stereo channels. A pre-processing stage 300 analyzes spatial cues and adjusts the input based upon a computed spatial ratio. The next stage 302 performs recursive crosstalk cancellation, as discussed below. Finally, a post processing stage 304 performs center stage processing, equalization and level control, as discussed below.

Figure 4:
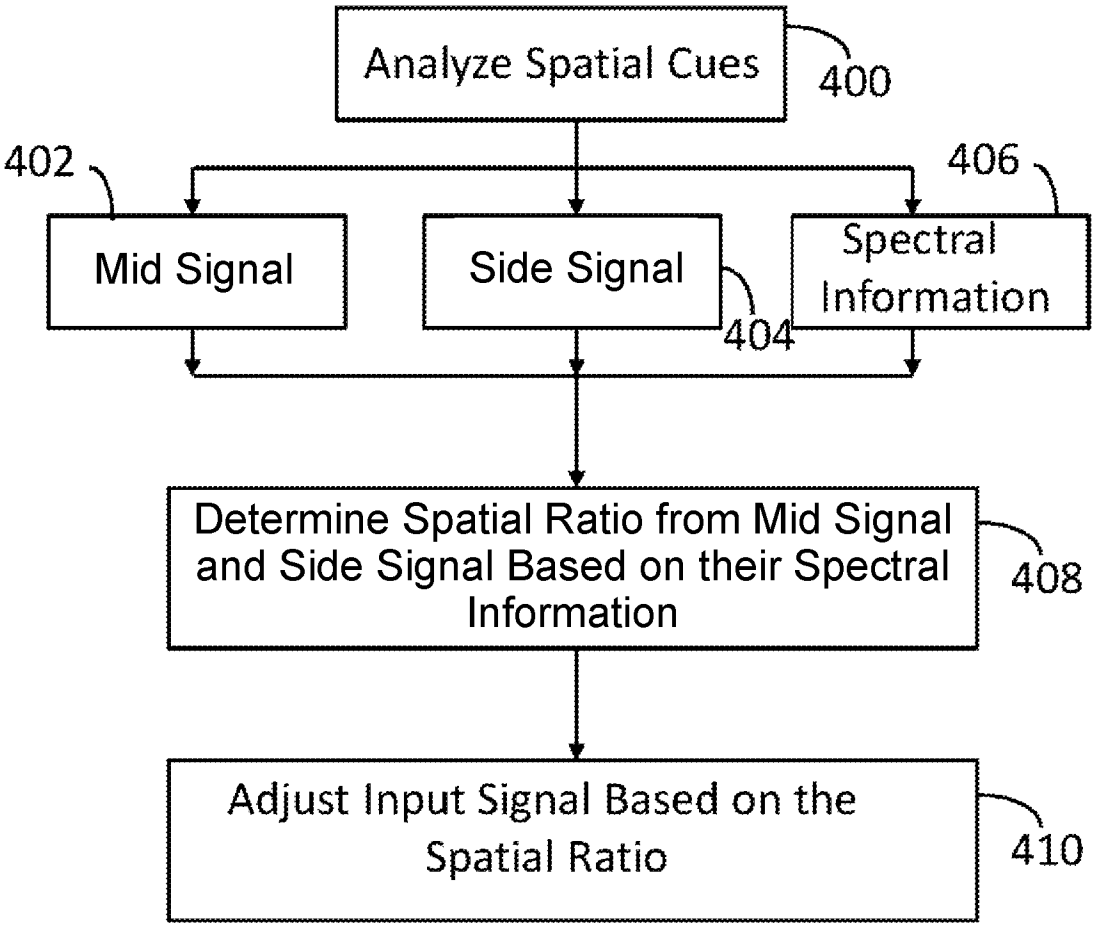
FIG. 4 illustrates processing operations associated with the pre-processing stage of the sound enhancement module.

FIG. 4 illustrates processing operations associated with the pre-processing stage 300. In the pre-processing stage, input sound is analyzed and a set of multi-scale features are added back to fit the information processing stages in the central auditory system so that a listener can clearly perceive and decode the information in the reproduced sound. In one embodiment, spatial cues are analyzed 400 in the form of sum signal 402, a difference signal 404 and spectral information 406. As illustrated in FIG. 3, the sum and the difference are calculated from the Left and Right inputs. The sum of the two channels represents the correlated component in the Left and Right channels, or the Mid signal. The sum signal 306 reveals the signal that appears at the phantom center, often the dialog in a movie, or the vocal in music. The difference of the two channels 308 is the hard-panned sound, or the Side signal. The difference signal determines the signal that appears only at or toward one of two speakers. The difference signal is often a special sound effect with components that appear on the sides. The spectrum is analyzed for spectral information. This is done because the center and hard-panned sound cannot adequately describe an audio file or stream. For example, crowd sound is very random; it may reside at the center and the side, or at the side alone. By analyzing the spectrum, one can decide whether a certain signal tagged by sum/difference steps is a main component (e.g., dialog, special sound effect) or more an ambient sound. In the frequency domain, ambience sound appears as a broad band sound, whereas sound effects or dialogs appear as envelope spectrums.

The next processing operation is to determine the spatial ratio from mid signal and side signal based on their spectral information 408. A "spatial ratio" (r) is estimated to represent the energy distribution between the main component and the ambience component within the mid signal and side signal. The stereo inputs are first sent to a mixing block 310, where the Left channel is calculated by $$\text{Left} = \begin{cases} \text{Left} & \text{if } LT \le r \le HT \\ G \cdot \alpha(Mid) + \beta(\text{Side}_L)) & \text{else.} \end{cases}$$

where LT and HT are low and high threshold for the acceptable spatial ratio. Both α and B are scalar regulation factors that are based on r. To be more concrete, α and B are calculated through a fixed linear transformation from r, so all terms are related to each other. G is a positive gain factor which ensures the amplitude of the result channel is the same as its input. The computations are the same for the Right channel.

Spatial ratio is calculated to represent the amount of main component and/or ambience component tagged by the three analyzing blocks (sum/difference/spectral information). It is used in the next pre-processing step (Mixing block 312) and also the Mixing in the post-processing stage, as shown on path 314. LT and HT are pre-set perceptual parameters which can be optimized based on individual content like music, films, or games to optimize their different natures. The threshold is adjusted based on the content type. Generally, any threshold value between 0.1 and 0.3 is reasonable. The system guesses the content type based on the tagged features. For example, a movie has a strong center, heavy ambience, and dynamic sound effects. In contrast, music has few ambiance tags and little overlap in spectral-temporal content between different sound sources.

A perceptual parameter is based upon a sensory experience, such as sound. The disclosed perception based technique relies upon the human brain to act as a decoder to pick up the recovered localization cues. The perceptual threshold considers only the information that is processed by the human brain/auditory system. Localization cues are recovered from the stereo digital audio signal so that the human auditory system can efficiently recognize and decode the audio signal. Thus, a perceptually continuous sound scape can be reconstructed without creating a virtual speaker. The disclosed techniques reconstruct sound in a perceptual space. That is, the disclosed techniques present information for the unconscious cognitive process to decode in the human auditory system.

The next processing operation of FIG. 4 is to adjust the input signal based on the Spatial Ratio 410 to obtain localization-critical information (i.e., information that a brain relies upon to localize sound). The ambiance sound is adjusted so that it is coherent over time and acts consistently with the main objects (dialog, sound effect). The ambiance sound is also important for the cognitive central to understand the environment. Different parts of the input signal are then adjusted based on the spatial ratio, its number of tags and the content type. In order to have a clear center image, one embodiment sets the minimum center to ambiance ratio at −10.5 dB.

The mixing block 312 balances the main component and the ambience component based on the comparison of the calculated spatial ratio and the selected perceptual thresholds. The thresholds may be selected by specifying an emphasis on main component or ambience component. A simple graphical user interface may be used to allow a user to select a balance between main component and ambience component. A simple graphical user interface may also be used to allow a user to select a volume level.

By doing this, a balance problem associated with prior art recursive crosstalk cancellation is solved. This is effectively an auto-balancing process. Moreover, this also ensures the surround components can be heard clearly by listeners.

Based on the Spatial Ratio and information from analyzing blocks, the original signal is remixed. Possible processing includes boosting the energy of the phantom center so that the phantom center is anchored at the center. Alternately, or in addition, special sound effects at the side may be emphasized so that they are expanded efficiently during recursive crosstalk cancellation. Alternately, or in addition, the ambient sound or background sound is spread throughout the sonic field without affecting center image. The amount of ambient sound may also be adjusted across time to keep a continuous immersive ambience.

Returning to FIG. 3, after pre-processing 300, recursive crosstalk cancellation 302 is performed. Crosstalk occurs when a sound reaches the ear on the opposite side from each speaker. Unwanted spectral coloration is caused because of constructive and destructive interference between the original signal and the crosstalk signal. In addition, conflicting spatial cues are created that cause spatial distortion. As a result, localization fails and the stereo image collapses to the position of the loudspeakers. The solution to this problem is crosstalk cancellation processing, which entails adding a crosstalk cancelling vector to the opposite speaker to acoustically cancel the crosstalk signal at a listener's eardrum. The conventional approach is to use HRTF for crosstalk cancellation. The simplified approach used herein merely adds the cancelling signal back to the opposite speaker. In particular, invert 314, attenuate 316 and delay 318 stages are used to form a high order recursive crosstalk canceler. The Left and Right channel can be calculated by:

$$\text{Left}(n)=\text{Left}(n)-A_L*\text{Right}(n-D_L)$$

$$\text{Right}(n)=\text{Right}(n)-A_R*\text{Left}(n-D_R)$$

where A, which stands for attenuation, is a positive scalar factor, D is a delay factor and n is the index of the given sample in the time domain. "In one embodiment, the parameters can be optimized to match the physical configuration of the hardware. For example, for a consumer electronic device with asymmetrical speakers or unbalanced sound intensity, the factors can be different between the two channels. The attenuation and delay time can be configured to fit any type of consumer electronic device speaker configuration.

Figure 5:
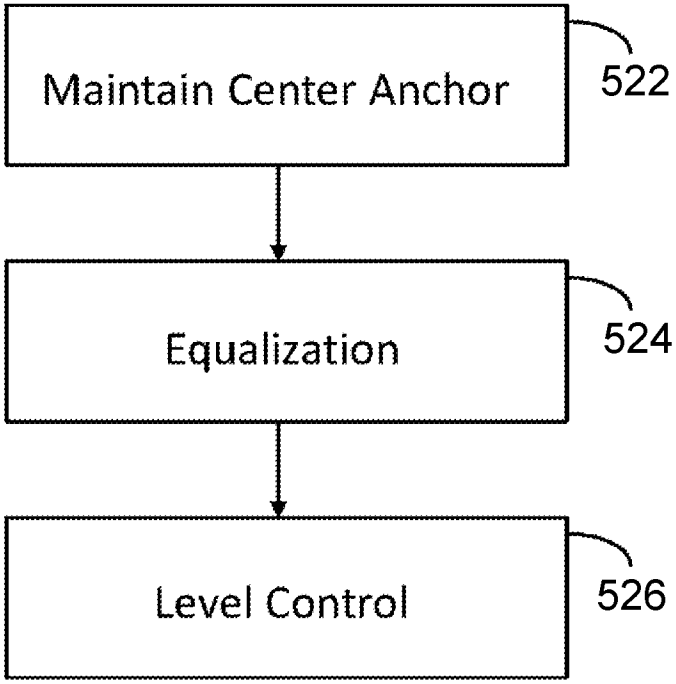
FIG. 5 illustrates processing operations associated with the post-processing stage of the sound enhancement module.

After recursive crosstalk cancellation 302, post-processing 304 is performed. FIG. 5 illustrates post-processing operations in the form of maintaining a center anchor 122, equalization 124 and level control 126. With respect to maintaining a center anchor 122, the output is adjusted again to keep the center stage strong enough for listeners, as it is an important feature to make the center content understandable. People are used to a strong center image. For example, if two speakers play the same signal at the same level, the phantom center will be perceived as being boosted by 3 dB by a listener on the central line. Therefore, if there is no more interference between the two speakers, no more acoustic summing will occur, nor will there be a 3 dB boost in the center. On the other hand, after recursive crosstalk cancellation, the depth and the room ambience of a stereo stream may be buried and therefore must be recovered. With such a feature, the audio content potentially appears to be farther away in the distance. The use of artificial reverberation or even a small pan from the center makes the center image drift to the side. For these reasons, the mixing block 320 determines if there is a need to add back center signals. The Left channel can be calculated by $$\text{Left} = \begin{cases} C \cdot \text{Left} & \text{if } r \le T \\ C' \cdot (\text{Left} + \alpha(Mid)) & \text{else.} \end{cases}$$

where r is the spatial ratio computed before and T is the perceptual threshold. The value of the threshold is based on the content type. For example, a movie requires a strong center image for the dialog, but a game does not. In one embodiment, the threshold is varied from 0.05 to 0.95. r is larger than T when the Mid signal takes an important role in the audio being played (e.g. main dialog). Note that the comparison of r and T also takes into account the original spatial ratio computed in the pre-processing state 408. $\alpha$ is a positive scalar factor with regard to r. C is another gain factor to ensure the output processed signal is the same loudness as the original input signal. The same process is also applied to the Right channel. Again, this process makes the center image more stable than prior art techniques, while keeping the widening effect at the side components. The stage width of the output signal can be manually adjusted. The previously discussed center and side graphical user interface may be used to establish this taste. For example, 100% width (a preference for 100% side sound) represents full effect/width such that a sound might appear from behind or right at the ear.

Following the mixing block 320, equalization 322 is applied to eliminate the audible coloration in high frequency bands created by using non-ideal delay and attenuate factors with respect to the size of the listener's head and the electronic device. Finally, a gain controlling block 324 makes sure every signal is within the proper amplitude range and has the same loudness as the original input signal. A user specified volume preference may also be applied at this point.

Other post-processing steps may include compression and peak limitation. They are used to preserve the dynamic range of loudspeakers and maintain the sound quality without unwanted coloration.

Those skilled in the art will appreciate that the techniques of the invention offer a low cost real-time computation process for source files, streamed content and the like. The techniques may also be embedded in digital audio signals (i.e., so that a decoder is not required). The techniques of the invention are applicable to sound bars, stereo loudspeakers, and car audio systems.

An embodiment of the present invention relates to a computer storage product with a non-transitory computer readable storage medium having computer code thereon for performing various computer-implemented operations. The media and computer code may be those specially designed and constructed for the purposes of the present invention, or they may be of the kind well known and available to those having skill in the computer software arts. Examples of computer-readable media include, but are not limited to: magnetic media, optical media, magneto-optical media and hardware devices that are specially configured to store and execute program code, such as application-specific integrated circuits ("ASICs"), programmable logic devices ("PLDs") and ROM and RAM devices. Examples of computer code include machine code, such as produced by a compiler, and files containing higher-level code that are executed by a computer using an interpreter. For example, an embodiment of the invention may be implemented using JAVA®, C++, or other programming language and development tools. Another embodiment of the invention may be implemented in hardwired circuitry in place of, or in combination with, machine-executable software instructions.

The foregoing description, for purposes of explanation, used specific nomenclature to provide a thorough understanding of the invention. However, it will be apparent to one skilled in the art that specific details are not required in order to practice the invention. Thus, the foregoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated. It is intended that the following claims and their equivalents define the scope of the invention.

What is claimed:

1. A computer-implemented method comprising:

at a computing device having one or more processors and memory for storing one or more program modules to be executed by the one or more processors:

balancing spatial energy distribution of right and left channels of a digital audio signal in accordance with a perceptual threshold, wherein the digital audio signal has a predefined center anchor;

performing recursive crosstalk cancellation on the balanced right and left channels of the digital audio signal to form a pair of crosstalk-cancelled right and left channels of the digital audio signal; and adjusting the pair of crosstalk-cancelled right and left channels of the digital audio signal so as to maintain the predefined center anchor of the digital audio signal.

2. The method of claim 1, wherein the step of balancing the spatial energy distribution further comprises:

generating a sum signal and a difference signal from the right and left channels of the digital audio signal;

estimating a spatial energy distribution of the right and left channels of the digital audio signal using the sum signal and the difference signal; and adjusting the estimated spatial energy distribution in accordance with the perceptual threshold.

3. The method of claim 1, wherein the perceptual threshold is determined by a content type of the digital audio signal.

4. The method of claim 1, wherein the pair of crosstalk-cancelled right and left channels of the digital audio signal is further processed to attenuate audible coloration in one or more high frequency bands of the digital audio signal.

5. The method of claim 1, wherein the step of performing recursive crosstalk cancellation further includes adding a cancelling signal from a first channel of the right and left channels into a second channel of the right and left channels without using a Head-Related Transfer Function.

6. The method of claim 5, wherein the cancelling signal for the second channel is an attenuated and time-delayed first channel based on a predefined physical configuration of a device for playing the crosstalk-cancelled audio signal.

7. A computing device comprising:

one or more processors;

memory; and one or more program modules stored in the memory and to be executed by the one or more processors, wherein the one or more program modules further include instructions for:

balancing spatial energy distribution of right and left channels of a digital audio signal in accordance with a perceptual threshold, wherein the digital audio signal has a predefined center anchor;

performing recursive crosstalk cancellation on the balanced right and left channels of the digital audio signal to form a pair of crosstalk-cancelled right and left channels of the digital audio signal; and adjusting the pair of crosstalk-cancelled right and left channels of the digital audio signal so as to maintain the predefined center anchor of the digital audio signal.

8. The computing device of claim 7, wherein the instruction for balancing the spatial energy distribution further comprises instructions for:

generating a sum signal and a difference signal from the right and left channels of the digital audio signal;

estimating a spatial energy distribution of the right and left channels of the digital audio signal using the sum signal and the difference signal; and adjusting the estimated spatial energy distribution in accordance with the perceptual threshold.

9. The computing device of claim 7, wherein the perceptual threshold is determined by a content type of the digital audio signal.

10. The computing device of claim 7, wherein the pair of crosstalk-cancelled right and left channels of the digital audio signal is further processed to attenuate audible coloration in one or more high frequency bands of the digital audio signal.

11. The computing device of claim 7, wherein the instruction for performing recursive crosstalk cancellation further includes adding a cancelling signal from a first channel of the right and left channels into a second channel of the right and left channels without using a Head-Related Transfer Function.

12. The computing device of claim 11, wherein the cancelling signal for the second channel is an attenuated and time-delayed first channel based on a predefined physical configuration of a device for playing the crosstalk-cancelled audio signal.

13. A non-transitory computer readable storage medium storing instructions executable by a computing device having one or more processors, wherein the instructions include;

balancing spatial energy distribution of right and left channels of a digital audio signal in accordance with a perceptual threshold, wherein the digital audio signal has a predefined center anchor;

performing recursive crosstalk cancellation on the balanced right and left channels of the digital audio signal to form a pair of crosstalk-cancelled right and left channels of the digital audio signal; and adjusting the pair of crosstalk-cancelled right and left channels of the digital audio signal so as to maintain the predefined center anchor of the digital audio signal.

14. The non-transitory computer readable storage medium of claim 13, wherein the instruction for balancing the spatial energy distribution further comprises instructions for:

generating a sum signal and a difference signal from the right and left channels of the digital audio signal;

estimating a spatial energy distribution of the right and left channels of the digital audio signal using the sum signal and the difference signal; and adjusting the estimated spatial energy distribution in accordance with the perceptual threshold.

15. The non-transitory computer readable storage medium of claim 13, wherein the perceptual threshold is determined by a content type of the digital audio signal.

16. The non-transitory computer readable storage medium of claim 13, wherein the pair of crosstalk-cancelled right and left channels of the digital audio signal is further processed to attenuate audible coloration in one or more high frequency bands of the digital audio signal.

17. The non-transitory computer readable storage medium of claim 13, wherein the instruction for performing recursive crosstalk cancellation further includes adding a cancelling signal from a first channel of the right and left channels into a second channel of the right and left channels without using a Head-Related Transfer Function.

18. The non-transitory computer readable storage medium of claim 17, wherein the cancelling signal for the second channel is an attenuated and time-delayed first channel based on a predefined physical configuration of a device for playing the crosstalk-cancelled audio signal.

* * * * *